US006147647A

United States Patent [19]

Tassoudji et al.

[11] Patent Number: 6,147,647

[45] Date of Patent: Nov. 14, 2000

[54] CIRCULARLY POLARIZED DIELECTRIC RESONATOR ANTENNA

[75] Inventors: Mohammad Ali Tassoudji, Cardiff; Ernest T. Ozaki, Poway; Yi-Cheng Lin, San Diego, all of Calif.

[73] Assignee: Qualcomm Incorporated, San Diego, Calif.

[21] Appl. No.: 09/150,157

[22] Filed: Sep. 9, 1998

[51] Int. Cl.[7] ..... H01Q 1/38

[52] U.S. Cl. ..... 343/700 MS; 343/725; 343/785; 343/829; 333/219.1

[58] Field of Search ..... 343/700 MS, 725, 343/727, 729, 785, 829, 873, 895; 333/219.1, 221.1, 202; H01Q 1/38

[56] References Cited

U.S. PATENT DOCUMENTS

| | | | |
|---|---|---|---|
| 4,125,837 | 11/1978 | Kaloi | 343/700 |
| 4,125,838 | 11/1978 | Kaloi | 343/700 |
| 4,125,839 | 11/1978 | Kaloi | 343/700 |
| 4,162,499 | 7/1979 | Jones, Jr. et al. | 343/700 |
| 4,218,682 | 8/1980 | Yu | 343/700 |
| 4,329,689 | 5/1982 | Yee | 343/700 |
| 4,692,769 | 9/1987 | Gegan | 343/700 |
| 5,396,202 | 3/1995 | Scheck | 333/230 |
| 5,453,754 | 9/1995 | Fray | 343/789 |
| 5,557,293 | 9/1996 | McCoy et al. | 343/867 |
| 5,748,154 | 5/1998 | Yokota | 343/702 |
| 5,940,036 | 8/1999 | Oliver et al. | 343/700 MS |
| 5,952,972 | 9/1999 | Ittipiboon et al. | 343/700 MS |

FOREIGN PATENT DOCUMENTS

| | | | |
|---|---|---|---|
| 0372451 | 6/1990 | European Pat. Off. | H01Q 5/00 |
| 0747990 | 12/1996 | European Pat. Off. | H01Q 1/24 |
| 04134906 | 5/1992 | Japan | H01Q 5/00 |
| 10126134 | 5/1998 | Japan | H01Q 1/38 |

OTHER PUBLICATIONS

"Circularly Polarized Dielectric Resonator Antenna", Mongia et al., Electronic Letters, Aug. 18, 1994, vol. 30, No. 17, pp. 1361–1362.

"Broadband Circularly Polarized Planar Array composed of a pair of Dielectric Resonator Antenna", Haneishi et al., May 9, 1985, vol. 21, No. 10, pp. 437–438.

G. Drossos, et al.; Switchable Cylindrical Dielectric Resonator Antenna; Electronics Letters; May 9, 1996; vol. 32; No. 10; pp. 862–864.

R. K. Mongia, et al.; Circularly Polarised Dielectric Resonator Antenna; Electronics Letters; Aug. 18, 1994; vol. 30; No. 17; pp. 1361–1362.

A. A. Kishk, et al.; Broadband Stacked Dielectric Resonator Antennas; Electronics Letters; Aug. 31, 1989; vol. 25; No. 18; pp. 1232–1233.

Martin et al., "Dielectric Resonator Antenna Using Aperture Coupling," Electronic Letters, Nov. 22, 1990, vol. 26, No. 24, pp. 2015–2016.

*Primary Examiner*—Don Wong
*Assistant Examiner*—Shih-Chao Chen
*Attorney, Agent, or Firm*—Phillip R. Wadsworth; Gregory D. Ogrod

[57] ABSTRACT

A dielectric resonator antenna having a resonator formed from a dielectric material mounted on a ground plane. The ground plane is formed from a conductive material. First and second probes are electrically coupled to the resonator for providing first and second signals, respectively, to or receiving from the resonator. The first and second probes are spaced apart from each other. The first and second probes are formed of conductive strips that are electrically connected to the perimeter of the resonator and are substantially orthogonal with respect to the ground plane. The first and second signals have equal amplitude, but 90 degrees phase difference with respect to each other, to produce a circularly polarized radiation pattern. A dual band antenna can be constructed by positioning and connecting two dielectric resonator antennas together. Each resonator in the dual band configuration resonates at a particular frequency, thereby providing dual band operation. The resonators can be positioned either side by side or vertically.

15 Claims, 7 Drawing Sheets

VERTICAL RADIATION PATTERN

AZIMITHAL RADIATION PATTERN

CIRCULARLY POLARIZED DIELECTRIC RESONATOR ANTENNA

BACKGROUND OF THE INVENTION

I. Field of the Invention

The present invention relates generally to antennas. More specifically, the present invention relates to a circularly polarized dielectric resonator antenna. Still more particularly, the present invention relates to a low profile dielectric resonator antenna for use with satellite or cellular telephone communication systems.

II. Description of the Related Art

Recent advances in mobile and fixed wireless phones, such as for use in satellite or cellular communications systems, have renewed interest in antennas suitable for such systems. Several factors are usually considered in selecting an antenna for a wireless phone. Significant among these factors are the size, the bandwidth and the radiation pattern of the antenna.

The radiation pattern of an antenna is a significant factor to be considered in selecting an antenna for a wireless phone. In a typical application, a user of a wireless phone needs to be able to communicate with a satellite or a ground station that can be located in any direction from the user. Thus, the antenna connected to the user's wireless phone preferably should be able to transmit and/or receive signals from all directions. That is, the antenna preferably should have an omnidirectional radiation pattern in azimuth and wide beamwidth (preferably hemispherical) in elevation.

Another factor that must be considered in selecting an antenna for a wireless phone is the antenna's bandwidth. Generally, a wireless phone transmits and receives signals at separate frequencies. For example, a PCS phone operates over a frequency band of 1.85–1.99 GHz, thus requiring a bandwidth of 7.29%. A cellular phone operates over a frequency band of 824–894 MHz that requires a 8.14% bandwidth. Accordingly, antennas for wireless phones must be designed to meet the required bandwidth.

Currently, monopole antennas, patch antennas and helical antennas are among the various types of antennas being used in satellite phones and other wireless-type phones. These antennas, however, have several disadvantages, such as limited bandwidth and large size. Also, these antennas exhibit significant reduction in gain at lower elevation angles (for example, 10 degrees), which makes them undesirable in satellite phones.

An antenna that appears attractive in wireless phones is the dielectric resonator antenna. Until recently, dielectric resonator antennas have been widely used in microwave circuits, such as filters and oscillators. Generally, dielectric resonators are fabricated from low loss materials that have high permittivity.

Dielectric resonator antennas offer several advantages, such as small size, high radiation efficiency and simple coupling schemes to various transmission lines. Their bandwidth can be controlled over a wide range by the choice of dielectric constant ($\epsilon_r$) and the geometric parameters of the resonator. They can also be made in low profile configurations, to make them more aesthetically pleasing than standard whip or upright antennas. A low profile antenna is also less subject to damage than an upright whip style antenna. Hence, the dielectric resonator antenna appears to have significant potential for use in mobile or fixed wireless phones for satellite or cellular communications systems.

SUMMARY OF THE INVENTION

The present invention is directed to a dielectric resonator antenna having a ground plane formed of a conductive material. A resonator formed of a dielectric material is mounted on the ground plane. First and second probes are spaced apart from each other and electrically coupled to the resonator to provide first and second signals, respectively, to the resonator, and produce circularly polarized radiation in the antenna. Preferably, the resonator is substantially cylindrical and has a central axial opening therethrough. Also preferably, the first and second probes are spaced approximately 90 degrees apart around the perimeter of the resonator.

In a further embodiment, the invention is directed to a dual band dielectric resonator antenna, having a first resonator formed of a dielectric material. The first resonator is mounted on a first ground plane formed of a conductive material. A second resonator is formed of a dielectric material and is mounted on a second ground plane formed of a conductive material. The first and second ground planes are separated from each other by a predetermined distance. First and second probes are electrically coupled to each of the resonators and are spaced approximately 90 degrees apart around the perimeter of each resonator to provide first and second signals, respectively, to each resonator. Each of the resonators resonates in a predetermined frequency band that differs between the resonators. Support members mount the first and second ground planes in spaced apart relation with a predetermined separation distance such that the central axes of the resonators are substantially aligned with each other.

In a still further embodiment, the invention is directed to a multiband antenna. A first antenna portion is tuned to resonate in a first predetermined frequency band. The first antenna portion includes a ground plane formed of a conductive material, a dielectric resonator formed of a dielectric material mounted on the ground plane, the resonator having a central longitudinal axial opening therethrough, and first and second probes spaced apart from each other and electrically coupled to the resonator to provide first and second signals, respectively, to the resonator, and produce circularly polarized radiation in the antenna. A second antenna portion is tuned to resonate in a second predetermined frequency band different from the first frequency band. The second antenna portion includes an elongated antenna member extending through the axial opening in the dielectric resonator and is electrically isolated therefrom. The longitudinal axis of the elongated antenna member is coincident with the axis of the dielectric resonator.

In a variation of the last mentioned embodiment, the invention may include a third antenna portion tuned to resonate in a third predetermined frequency band different from the first and second frequency bands. The third antenna portion extends through the axial opening in the dielectric resonator and is electrically isolated from the first and second antenna portions. The third antenna portion has a longitudinal axis coincident with the longitudinal axes of the first and second antenna portions.

Further features and advantages of the invention, as well as the structure and operation of various embodiments of the invention, are described in detail below with reference to the accompanying drawings.

BRIEF DESCRIPTION OF THE DRAWINGS

In the drawings, like reference numbers generally indicate identical, functionally similar, and/or structurally similar elements. The drawing in which an element first appears is indicated by the leftmost digit(s) in the reference number.

The present invention will be described with reference to the accompanying drawings, wherein.

DETAILED DESCRIPTION OF THE PREFERRED EMBODIMENTS

I. Dielectric Resonators

Figure 1A:
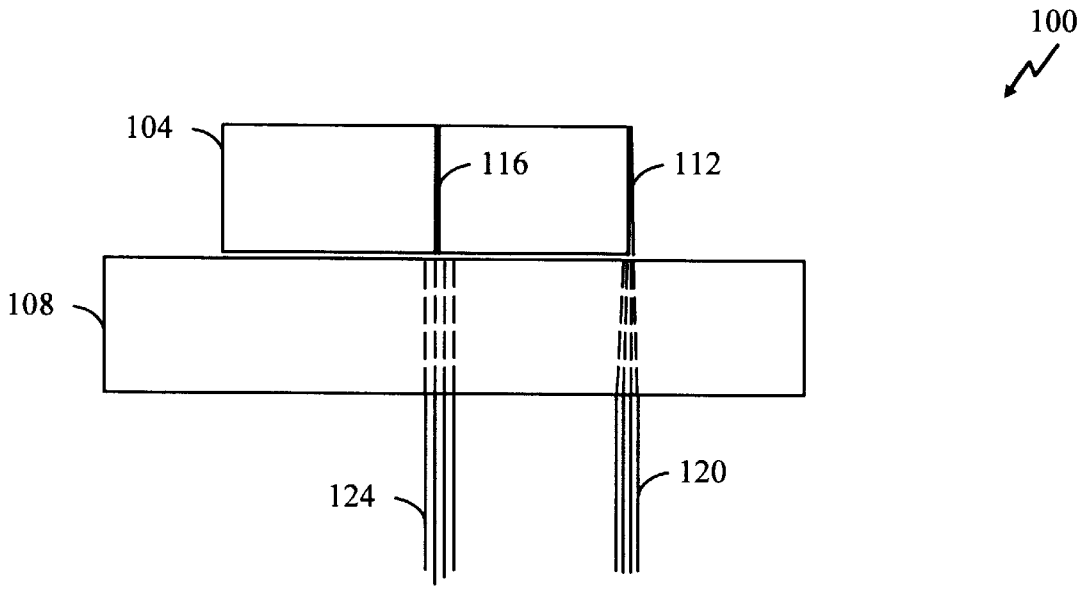
FIGS. 1A and 1B illustrate a side view and a top view, respectively, of a dielectric resonator antenna in accordance with one embodiment of the present invention.

Dielectric resonators offer attractive features as antenna elements. These features include their small size, mechanical simplicity, high radiation efficiency because there is no inherent conductor loss, relatively large bandwidth, simple coupling schemes to nearly all commonly used transmission lines, and the advantage of obtaining different radiation characteristics using different modes of the resonator.

The size of a dielectric resonator is inversely proportional to the square root of $\epsilon_r$, where $\epsilon_r$ is the dielectric constant of the resonator. As a result, as the dielectric constant $\epsilon_r$ increases, the size of the dielectric resonator decreases, $\epsilon_r$ increases. Consequently, by choosing a high value of $\epsilon_r$ ($\epsilon_r$=10–100), the size (especially the height) of the dielectric resonator antenna can be made quite small.

The bandwidth of the dielectric resonator antenna is inversely proportional to $(\epsilon_r)^{-P}$, where the value of p (p>1) depends upon the mode. As a result, the bandwidth of the dielectric resonator antenna decreases with an increase in the dielectric constant. It must be noted, however, that the dielectric constant is not the only factor determining the bandwidth of a dielectric resonator antenna. The other factors affecting the bandwidth of the dielectric resonator are its shape and dimensions (height, length, diameter, etc.).

There is no inherent conductor loss in dielectric resonator antennas. This leads to high radiation efficiency of the antenna.

The resonant frequency of a dielectric resonator antenna can be determined by computing the value of normalized wavenumber $k_0a$. The wavenumber $k_0a$ is given by the relationship $k_0a=2\pi f_0/c$, where $f_0$ is the resonant frequency, a is the radius of the cylinder, and c is the velocity of light in free space. However, if the value of $\epsilon_r$ is very high, ($\epsilon_r$>100), the value of the normalized wavenumber varies with $\epsilon_r$, as $$k_0a \propto \frac{1}{\sqrt{\epsilon_r}} \tag{1}$$

for a given aspect ratio of a dielectric resonator.

For high values of $\epsilon_r$, the value of the normalized wavenumber as a function of the aspect ratio (H/2a) can be determined for a single value of $\epsilon_r$. However, if the $\epsilon_r$ of the material used is not very high, the formula of eqn. (1) does not hold exactly. If the value of $\epsilon_r$ is not very high, computations are required for each different value of $\epsilon_r$. By comparing results from numerical methods available for different values of $\epsilon_r$, it has been found that the following empirical relationship can be used as a good approximation to describe the dependence of the normalized wavenumber as a function of $\epsilon_r$, $$k_0a \propto \frac{1}{\sqrt{\epsilon_r X}} \tag{2}$$

where the value of X is found empirically from the results of the numerical methods.

The impedance bandwidth of a dielectric resonator antenna is defined as the frequency bandwidth in which the input Voltage Standing Wave Ratio (VSWR) of the antenna is less than a specified value S. VSWR is a function of an incident wave and a reflected wave in a transmission line, and it is a well known terminology used in the art. The impedance bandwidth ($BW_i$) of an antenna, which is matched to a transmission line at its resonant frequency, is related to the total unloaded Q-factor ($Q_u$) of a dielectric resonator by the following relation:

$$BW_i = \frac{S-1}{Q_u\sqrt{S}} \tag{3}$$

Note that Q is proportional to the ratio of the energy stored to the energy lost in heat or radiation, and it is a well known terminology used in the art. For a dielectric resonator, which has a negligible conductor loss compared to its radiated power, the total unloaded Q-factor ($Q_u$) is related to the radiation Q-factor ($Q_{rad}$) by the following relation, $$Q_u \approx Q_{rad} \tag{4}$$

Numerical methods are required to compute the value of the radiation Q-factor of a dielectric resonator. For a given mode, the value of the radiation Q-factor depends on the aspect ratio and the dielectric constant of a resonator. It has been shown that for resonators of very high permittivity, $Q_{rad}$ varies with $\epsilon_r$ as $$Q_{rad} \alpha (\epsilon_r)^P \tag{5}$$

where the permitivity (p)=1.5, for modes that radiate like a magnetic dipole; p=2.5, for modes that radiate like an electric dipole; and p=2.5, for modes that radiate like a magnetic quadrupole.

II. The Invention

According to the present invention, a dielectric resonator antenna comprises a resonator formed of a dielectric material. The dielectric resonator is placed on a ground plane formed of a conductive material. First and second probes or conductive leads are electrically connected to the dielectric resonator. The probes are spaced apart from each other by 90 degrees. The first and second probes provide the dielectric resonator with first and second signals, respectively. The first and second signals have equal magnitudes, but are 90° out of phase with respect to each other.

Figure 1B:
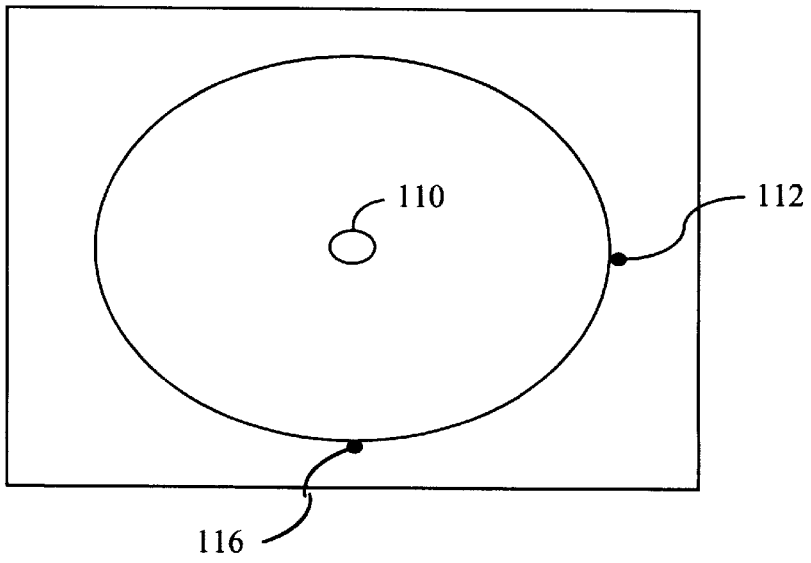

FIGS. 1A and 1B illustrate a side view and a top view, respectively, of a dielectric resonator antenna 100 according to one embodiment of the present invention. Dielectric resonator antenna 100 comprises a resonator 104 mounted on a ground plane 108.

Resonator 104 is formed of a dielectric material and, in a preferred embodiment, has a cylindrical shape. Resonator 104 may have other shapes, such as rectangular, octagonal, square, etc. Resonator 104 is tightly mounted on ground plane 108. In one embodiment, resonator 104 is attached to ground plane 108 by means of an adhesive, preferably an adhesive having conductive properties. Alternatively, resonator 104 may be attached to ground plane 108 by a screw, bolt or other known fastener (shown in FIG. 2B) extending through an opening 110 in the center axis of resonator 104 for the modes that radiate like a magnetic dipole and into ground plane 108. Since a null exists at the center axis of resonator 104, the fastener will not interfere with the radiation pattern of antenna 100.

In order to prevent a degradation of the dielectric resonator antenna's performance, including its bandwidth and its radiation pattern, it is necessary to minimize any gap between resonator 104 and ground plane 108. This is preferably achieved by tightly mounting resonator 104 on ground plane 108. Alternatively, any gap between resonator 104 and ground plane 108 can by filled by a pliable or a malleable conductive material. If resonator 104 is loosely mounted on ground plane 108, there will remain an unacceptable gap between the resonator and the ground plane, which will degrade the performance of the antenna by distorting the VSWR, resonant frequency, and radiation pattern.

Two feed probes 112 and 116 are electrically connected to resonator 104 through a passage in ground plane 108. In a preferred embodiment, feed probes 112 and 116 (shown in FIG. 2A) are formed of metal strips axially aligned with and connected to the perimeter of resonator 104. Feed probes 112 and 116 may comprise extensions of the inner conductors of coaxial cables 120 and 124, the outer conductors of which may be electrically connected to ground plane 108. Coaxial cables 120 and 124 may be connected to radio transmit and receive circuits (not shown) in a known manner.

Feed probes 112 and 116 are separated from each other by approximately 90 degrees and are substantially orthogonal to ground plane 108. Feed probes 112 and 116 provide first and second signals, respectively, to resonator 104. The first and second signals have equal amplitude, but are out of phase with respect to each other by 90 degrees.

When resonator 104 is fed by two signals having equal magnitude, but which are out of phase with respect to each other by 90 degrees, two magnetic dipoles that are substantially orthogonal to each other are produced above the ground plane. The orthogonal magnetic dipoles produce a circularly polarized radiation pattern.

In one embodiment, resonator 104 is formed from a ceramic material, such as barium titanate. Barium titanate has a high dielectric constant $\epsilon_r$. As noted before, the size of the resonator is inversely proportional to $\sqrt{\epsilon_r}$. Thus, by choosing a high value of $\epsilon_r$, the resonator 104 may be made relatively small. However, other dielectric materials having similar properties can also be used, and other sizes are allowed depending upon specific applications.

Antenna 100 has a significantly lower height than a quadrafilar helix antenna operating at the same frequency band. For example, a dielectric resonator antenna operating at S-band frequencies has a significantly lower height than a quadrafilar helix antenna also operating at S-band frequencies. A lower height makes a dielectric resonator antenna more desirable in wireless phones.

Tables I and II below compare the dimensions (height and diameter) of a dielectric resonator antenna with a typical quadrafilar helix antenna operating at L-band frequencies (1–2 GHz range) and S-band frequencies 2–4 GHz range), respectively.

TABLE I

| Antenna type | height | Diameter |
|---|---|---|
| Dielectric resonator antenna (S-band) | 0.28 inches | 2.26 inches |
| Quadrafilar helix antenna (S-band) | 2.0 inches | 0.5 inches |

TABLE II

| Antenna type | height | Diameter |
|---|---|---|
| Dielectric resonator antenna (L-band) | 0.42 inches | 3.38 inches |
| Quadrafilar helix antenna (L-band) | 3.0 inches | 0.5 inches |

Tables I and II show that, although a dielectric resonator antenna has a smaller height than a quadrafilar helix antenna operating at the same frequency band, a dielectric resonator antenna has a larger diameter than a quadrafilar helix antenna. In other words, the advantage gained by the reduction in height of a dielectric resonator antenna appears to be offset by a larger diameter in some applications. In reality, a larger diameter is not of a great concern, because the primary goal of this antenna design is to obtain a low profile. A dielectric resonator antenna of this invention could be built into a car roof without significantly altering the roof line. Similarly, an antenna of this type could be mounted on a remotely located fixed phone booth of a wireless satellite telephone communication system.

Furthermore, antenna 100 provides significantly lower loss than a comparable quadrafilar helix. This is due to the fact that there is no conductor loss in dielectric resonators, thereby leading to high radiation efficiency. As a result, antenna 100 requires a lower power transmit amplifier and lower noise figure receiver than would be required for a comparable quadrafilar helix antenna.

Reflected signals from ground plane 108 can destructively add to the radiated signals from resonator 104. This is often referred to as destructive interference, which has the undesirable effect of distorting the radiation pattern of antenna 100. In one embodiment, the destructive interference is reduced by forming a plurality of slots in ground plane 108. These slots alter the phase of the reflected waves, thereby preventing reflected waves from destructively summing and distorting the radiation pattern of antenna 100.

The field around the edge of ground plane 108 also interferes with the radiation pattern of antenna 100. This interference can be reduced by serating the edge of ground plane 108. Serating the edge of ground plane 108 reduces the coherency of the fields near the edge of ground plane 108, which reduces the distortion of the radiation pattern by making antenna 100 less susceptible to the surrounding fields.

In actual operation, two separate antennas are often desired for transmit and receive capabilities. For example, in a satellite telephone system, a transmitter may be configured to operate at L band frequencies and a receiver may be configured to operate at S band frequencies. In that case, an L band antenna may operate solely as a transmit antenna and an S band antenna may operate solely as a receive antenna.

Figure 2A:
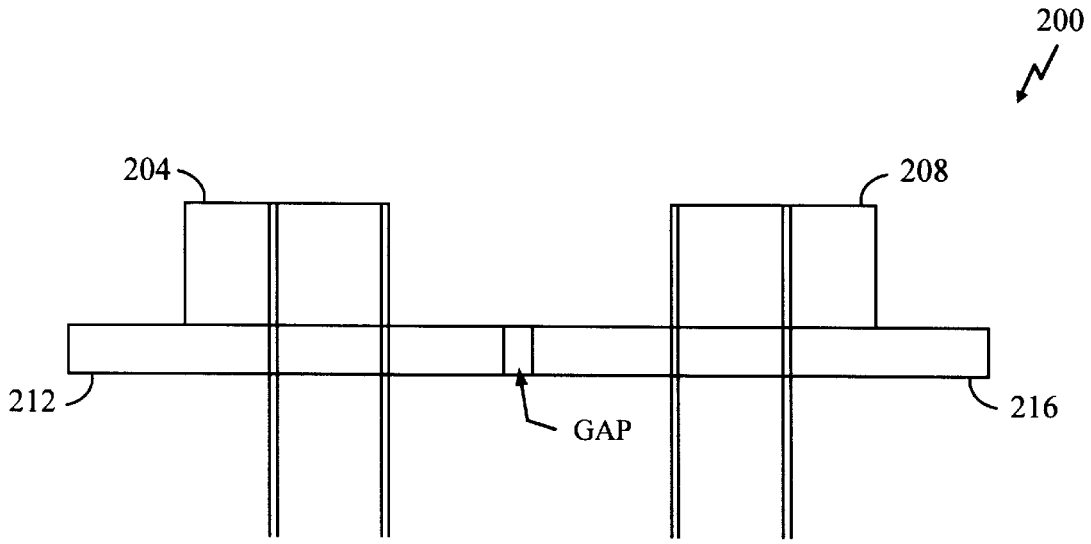
FIG. 2A illustrates an antenna assembly comprising two dielectric resonator antennas connected side-by-side.

FIG. 2A illustrates an antenna assembly 200 comprising two antennas 204 and 208. Antenna 204 is an L band antenna operating solely as a transmit antenna, while antenna 208 is an S band antenna operating solely as a receive antenna. Alternatively, the L band antenna can operate solely as a receive antenna, while the S band antenna can operate solely as a transmit antenna. Antennas 204 and 208 may have different diameters depending on their respective dielectric constants $\epsilon_r$.

Antennas 204 and 208 are connected together along ground planes 212 and 216. Since antenna 204 operates as a transmit antenna, the radiated signal from antenna 204 excites ground plane 216 of antenna 208. This causes undesirable electromagnetic coupling between antennas 204 and 208. The electromagnetic coupling can be minimized by selecting an optimum gap 218 between ground planes 212 and 216. The optimum width of gap 218 can be determined experimentally. Experimental results have shown that the electromagnetic coupling between antennas 204 and 208 increases if gap 218 is greater or less than the optimum gap spacing. The optimum gap spacing is a function of the operating frequencies of antennas 204 and 208 and the size of ground planes 212 and 216. For example, it has been determined that for an S-band antenna and an L-band antenna configured side-by-side as illustrated in FIG. 3A, the optimum gap spacing is 1 inch; that is, ground planes 212 and 216 should be separated by 1 inch for good performance.

Figure 2B:
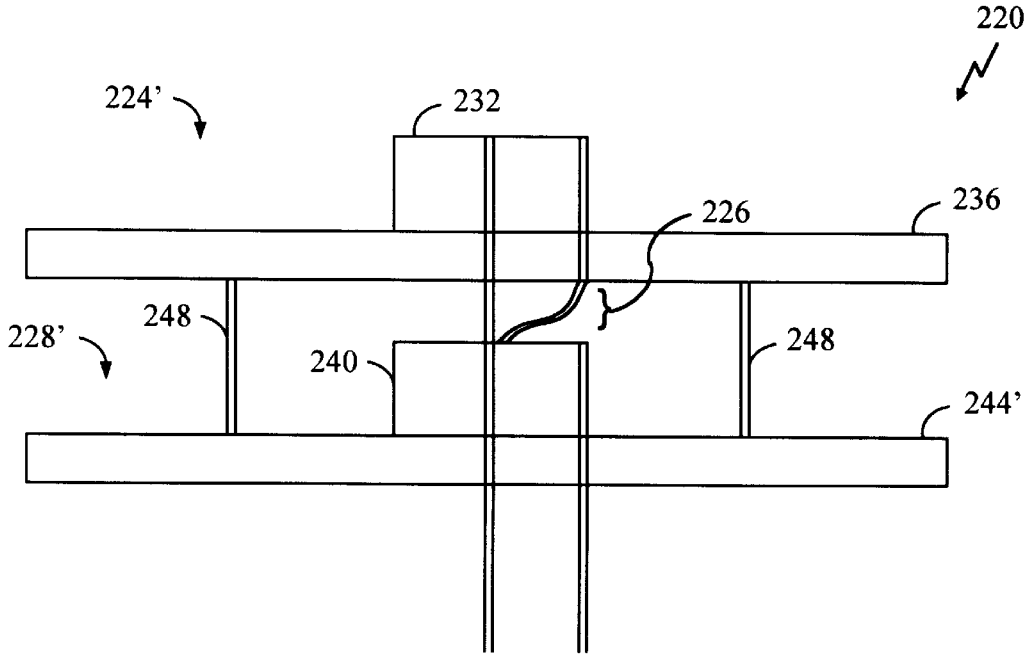
FIG. 2B illustrates an antenna assembly comprising two stacked dielectric resonator antennas connected vertically.

Alternatively, an S-band antenna and an L-band antenna can be stacked vertically. FIG. 2B shows an antenna assembly 220 comprising an S-band antenna 224 and an L-band antenna 228 stacked vertically along a common axis. Alternatively, antennas 224 and 228 may be stacked vertically, but not along a common axis, that is, they may have their central axes offset from each other. Antenna 224 comprises a dielectric resonator 232 and a ground plane 236, and antenna 228 comprises a dielectric resonator 240 and a ground plane 244. Ground plane 236 of antenna 224 is placed on top of dielectric resonator 240 of antenna 228. Non-conducting support members 248 fix antenna 224 in spaced relation to antenna 228 with a gap 226 between ground plane 236 and resonator 240.

Figure 2C:
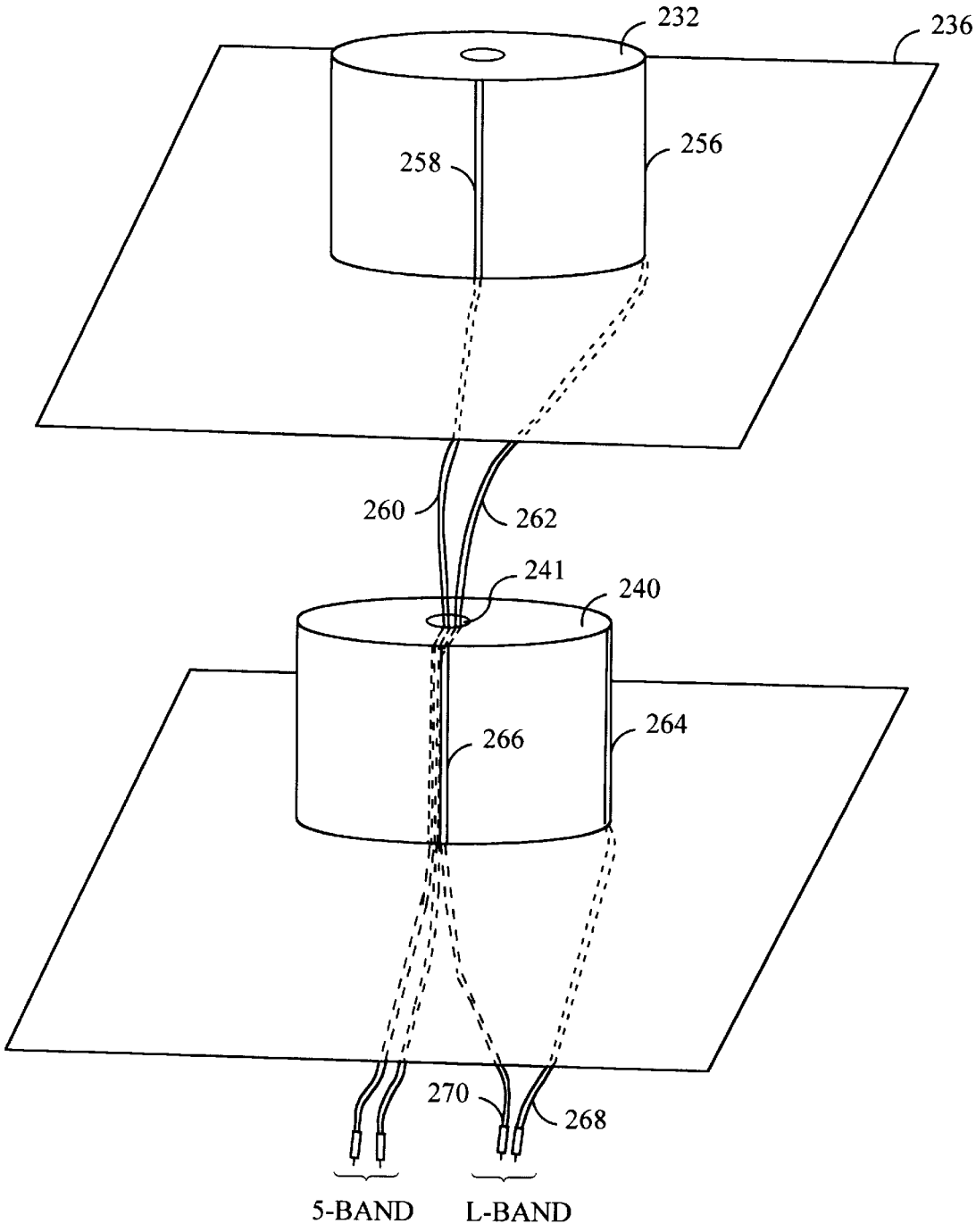
FIG. 2C shows the feed probe arrangement of the stacked antenna assembly of FIG. 2B

FIG. 2C shows the feed probe arrangement of the stacked antenna assembly of FIG. 2B in more detail. Upper resonator 232 is fed by feed probes 256 and 258. Conductors 260 and 262, which connect the feed probes to transmit/receive circuitry (not shown), extend through central opening 241 in lower resonator 240. Lower resonator 240 is fed by feed probes 264 and 266, which, in turn, are connected to the transmit/receive circuitry by conductors 268 and 270. In the exemplary embodiment shown, upper resonator 232 operates on the S-Band, while lower resonator 240 operates on the L-Band. It will be apparent to those skilled in the relevant art that these band designations are only exemplary. The resonators can operate on other bands. Additionally, the S-Band and L-Band resonators can be reversed, if desired.

An optimum gap spacing should be maintained between antennas 224 and 228 to reduce coupling between the antennas. As with the previously described embodiment, this optimum gap spacing is determined empirically. For example, it has been determined that for an S-band antenna, and an L-band antenna configured vertically as illustrated in FIGS. 2B and 2C, the optimum gap 226 is 1 inch, that is, ground plane 236 should be separated from dielectric resonator 240 by 1 inch.

The dielectric resonator antenna is suitable for use in satellite phones (fixed or mobile), including phones having antennas mounted on roof-tops (for example, an antenna mounted on the roof of a car) or other large flat surfaces. These applications require that the antenna operate at a high gain at low elevation angles. Unfortunately, antennas in use today, such as patch antennas and quadrafilar helix antennas, do not exhibit high gain at low elevation angles. For example, patch antennas exhibit −5 dB gain at around 10 degrees elevation. In contrast, dielectric resonator antennas of the type to which this invention is directed exhibit −1.5 dB gain at around 10 degrees elevation, thereby making them attractive for use as low profile antennas in satellite phone systems.

Another noteworthy advantage of a dielectric resonator antenna is its ease of manufacture. A dielectric resonator antenna is easier to manufacture than either a quadrafilar helix antenna or a microstrip patch antenna.

Table III lists parameters and dimensions for an exemplary L band dielectric resonator antenna.

TABLE III

| | |
|---|---|
| Operating frequency | 1.62 GHz |
| Dielectric constant | 36 |
| ground plane dimension | (3 inches) × (3 inches) |

Figure 3:
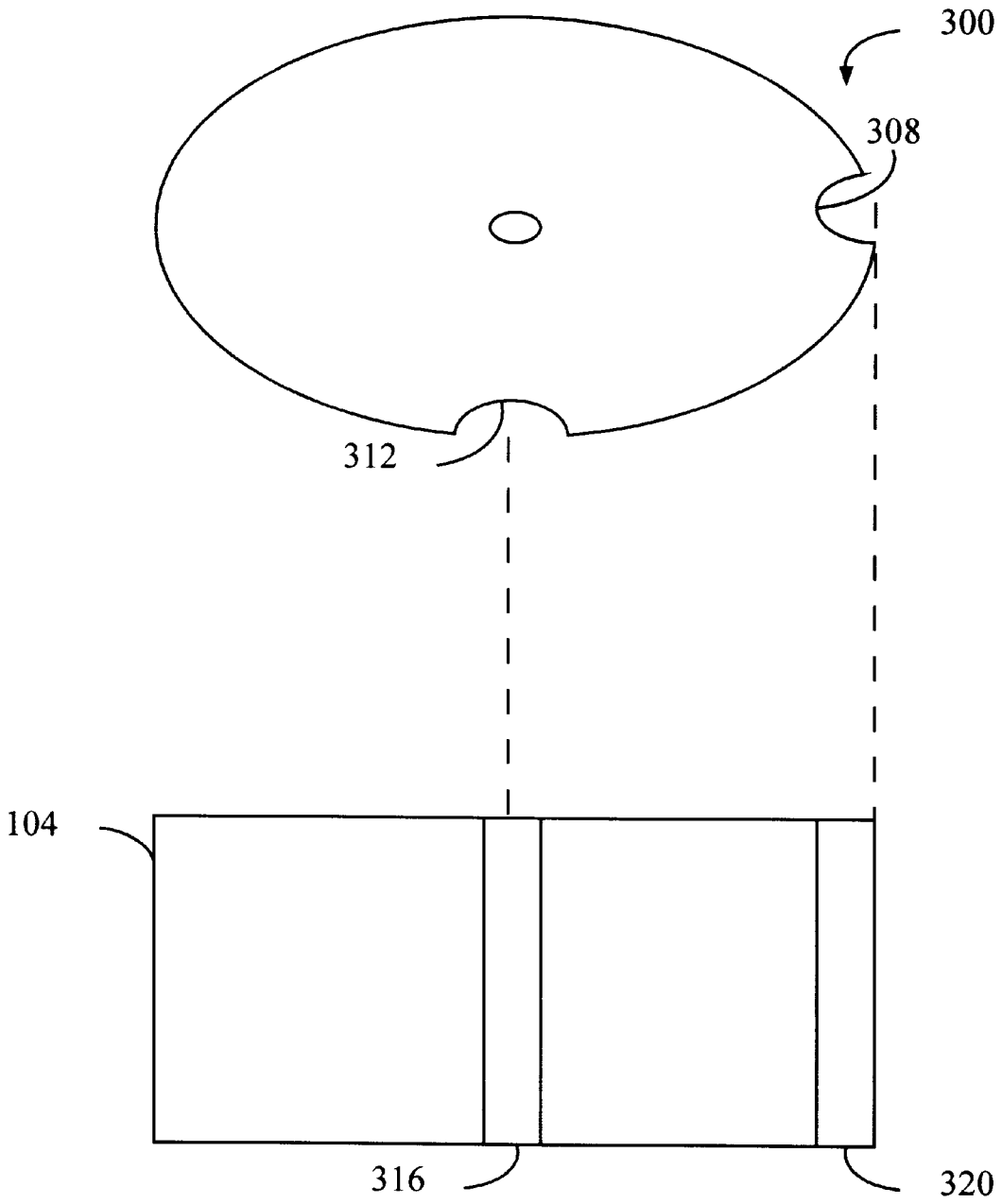
FIG. 3 illustrates a circular plate sized to be placed under a dielectric resonator.

FIG. 3 shows a conductive circular plate 300 sized to be placed between dielectric resonator 104 and ground plane 108. Circular plate 300 electrically connects dielectric resonator 104 to the ground plane. Circular plate 300 reduces the dimensions of any air gap between dielectric resonator 304 and ground plane 108, thereby inhibiting deterioration of the antenna's radiation pattern. Circular plate 300 includes two semi-circular slots 308 and 312 at its perimeter. Slots 308 and 312, however, can also have other shapes. Slots 308 and 312 are spaced apart from each other along a circumference by 90 degrees and are sized to receive appropriately shaped feed probes. Dielectric resonator 104 includes two notches 316 and 320 at its perimeter. Each notch is sized to receive a feed probe and is coincident with a slot of circular plate 300. Slots 316 and 320 can also be plated with conductive material to attach to the feed probes.

Figure 4A:
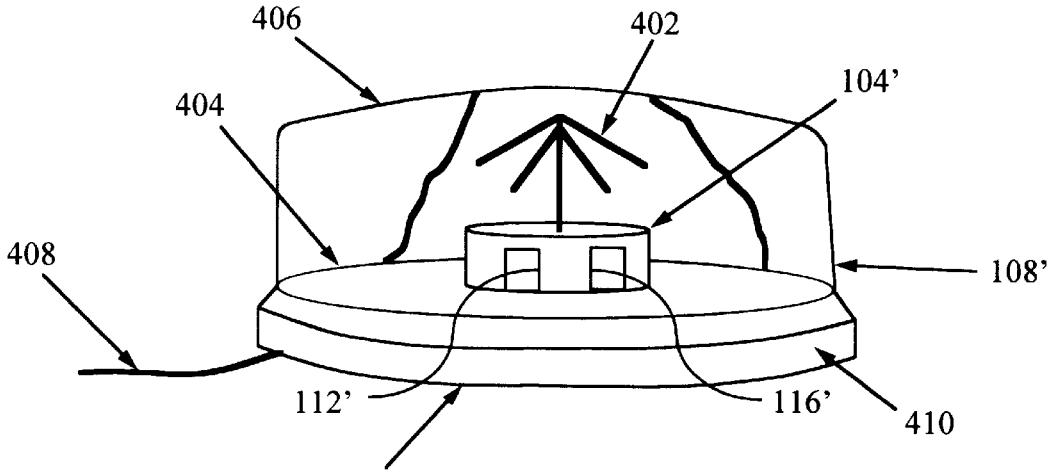
FIG. 4A illustrates another embodiment that incorporates a crossed dipole antenna with a dielectric resonator.

FIG. 4A shows an embodiment which incorporates a dielectric resonator antenna and a crossed dipole antenna. This embodiment integrates a dielectric resonator antenna 104' operating at satellite telephone communications systems uplink frequencies (L-band) with a bent crossed-dipole antenna 402 operating at satellite telephone communications systems downlink (S-band) frequencies. Dielectric resonator antenna 104' is mounted to a ground plane 108'. A conductively clad printed circuit board (PCB) 404 forms the top of ground plane 108' to which dielectric resonator antenna 104' is attached. On the other side of PCB 404 is a printed quadrature microwave circuit (not shown) whose outputs feed the orthogonally-placed conductive strips or feed probes 112' and 116' on the sides of the dielectric resonator antenna. Right angle conductive via holes from the feed outputs to the upper ground plane surface 404 carry the uniform amplitude but quadrature phased signals to the conductive strips. The strips (not shown) wrap around and continue part way across the bottom of the antenna 104', thereby providing for a novel and low cost way to attach the puck to the via hole islands by use of conventional wave soldering techniques. A low profile radome 406 covers both antennas. A cable 408 is connected to conductive strips 112' and 116' for carrying uplink/downlink RF signals and DC bias for the active electronics in the housing.

The entire antenna unit is mounted to a base member 410. Base 410 may advantageously be made of a magnetic material or have a magnetic surface for mounting the antenna unit to a car or truck roof.

Dielectric resonator antenna 104' is formed from a cylindrically shaped piece called a "puck" made of high dielectric (hi-K) ceramic material (that is, $E_r$>45). The hi-K material allows for a reduction in the size required for resonance at L-band frequencies. The puck is excited in the ($HEM_{11\Delta}$) mode by the two orthogonally-placed conductive strips 112' and 116'. This mode allows for hemispherically-shaped, circularly-polarized radiation. The diameter and shape of ground plane 108' can be adjusted to improve antenna coverage at near horizon angles.

The $HEM_{11\Delta}$ mode fields in and around the puck do not couple to structures placed along the axis of the puck. Thus, a single transmission line (coax or printed stripline) feeding the dipole pairs can protrude through the center of the Dielectric resonator antenna without adversely effecting the radiation pattern of the Dielectric resonator antenna. In addition, the dipole arms are not resonant at L-band frequencies so that L to S band coupling is minimized. The crossed-dipoles are placed at a distance of about ⅓ wavelength (1.7 inches at satellite downlink frequencies) above the ground plane 108'. Excited in this way, the dipoles produce hemispherical circularly polarized radiation patterns ideal for satellite communications applications. The height above the ground plane and angle at which the dipole arms are bent can be adjusted to give different radiation pattern shapes which emphasize reception at lower elevation angles instead of at zenith. The effect of the presence of the puck below the dipoles can be also be accommodated in this fashion.

In a variation of the embodiment of FIG. 4, the crossed dipole antenna can be replaced by a quadrifiler helix antenna (QFHA). The QFHA is a printed antenna wrapped around in a cylinder shape. The diameter can be made small(<0.5"). The antenna can be suspended above the dielectric resonator antenna using a plastic stalk with the stalk and QFHA axis coincident with the dielectric resonator antenna axis. The radiation pattern of the QFHA has a null directed towards the ground plane so that coupling effects to the dielectric resonator antenna and ground plane are minimized. Since the QFHA aligned along the axis of the dielectric resonator antenna is of small diameter, the L-band dielectric resonator antenna patterns are not distorted by the presence of the QFHA.

Figure 4B:
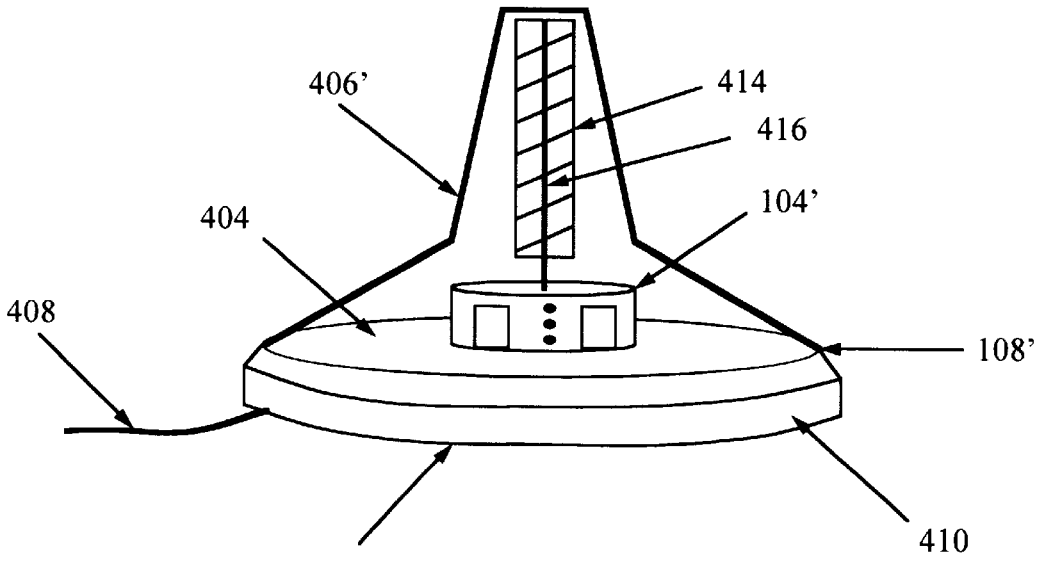
FIG. 4B illustrates a further embodiment that incorporates a quadrifilar helix and a monopole whip with the dielectric resonator antenna.

In a still further variation shown in FIG. 4B, a quadrifilar helix antenna 414 is mounted with its central axis coincident with the central axis of dielectric resonator antenna 104'. A ¼ wavelength whip antenna 416 is installed along the common axis of QFHA 414 and dielectric resonator antenna 104'. Since dielectric resonator antenna 104' and QFHA 414 have null fields along their axis, coupling to whip 416 is minimized. This whip can be used for communication in the 800 Mhz cellular band.

Following are some of the features of the dielectric resonator antenna of this invention.

- Hi-K dielectric resonator antenna offers a low profile, small-size antenna for L-band satellite communications applications.
- Plating strips on the sides and bottom of the dielectric resonator antenna puck allow for a novel and low cost attachment method to the PCB feed.
- Use of an integral PCB to feed the dielectric resonator antenna allows for mounting of a transmit power amplifier at the antenna port, thereby minimizing transmission line losses and improving efficiency.
- Use of a hybrid dielectric resonator antenna circularly polarized mode allows for integration of other antenna types along the dielectric resonator antenna axis, thereby allowing for multifunction, multiband performance in a single low profile assembly.
- Use of S-band dipoles that are non-resonant at L-band further decouples the L-band from the S-band antenna.
- S band dipoles are very low cost and have many adjustments available to change the S-band pattern shape.

Figure 5:
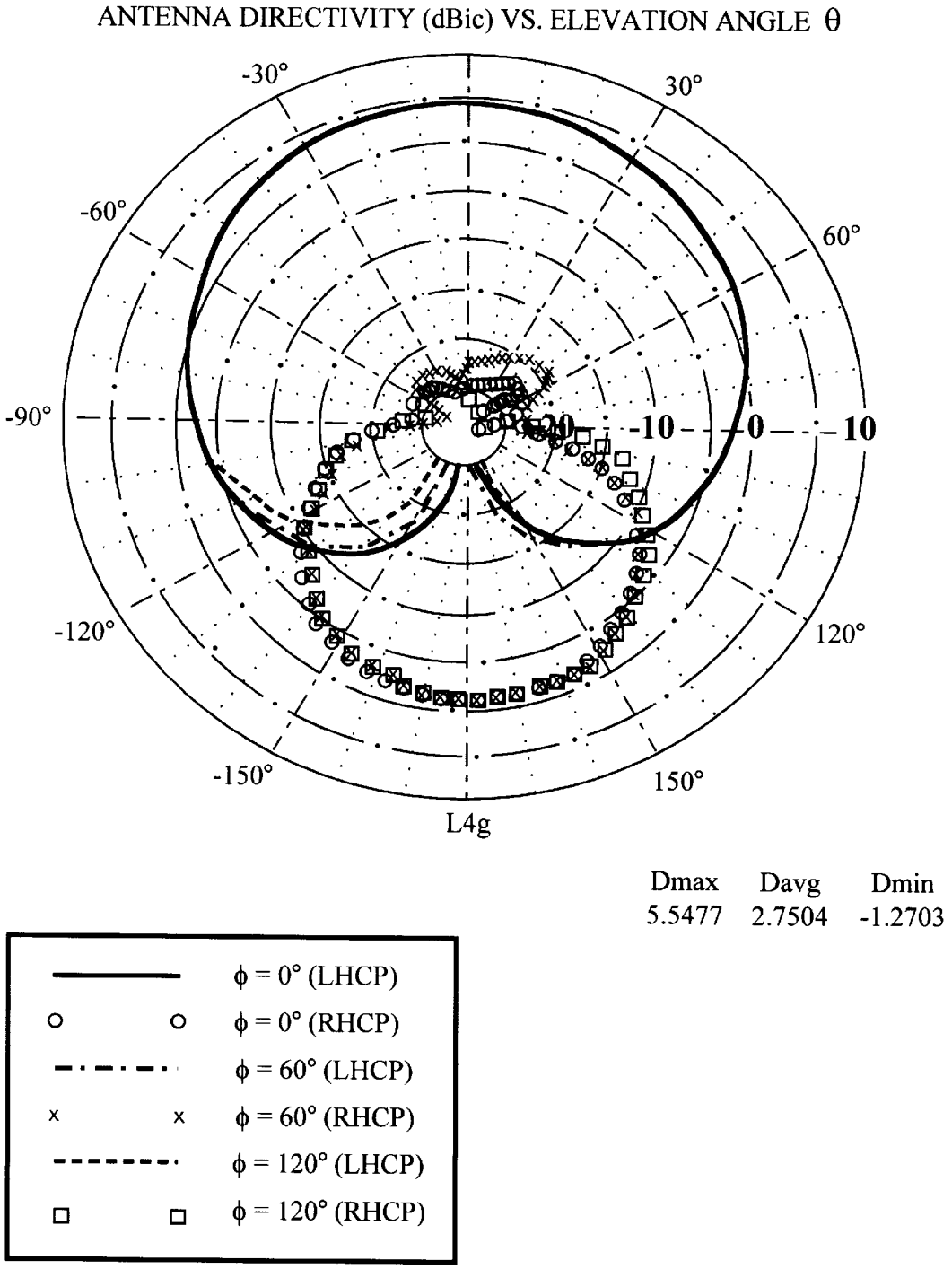
FIG. 5 illustrates a computer simulated antenna directivity vs. elevation angle plot of a dielectric resonator antenna constructed according to the invention and operating at 1.62 GHz.

FIG. 5 illustrates a computer simulated antenna directivity vs. elevation angle plot of a dielectric resonator antenna constructed according to the invention and operating at 1.62 GHz. The dielectric constant $\epsilon_r$ of the resonator is selected to be 45 and the ground plane has a diameter of 3.4 inches. Although, in this simulation, the ground plane was chosen to have a circular shape, other shapes can also be chosen. The simulation results indicate that the maximum gain is 5.55 dB, the average gain is 2.75 dB and the minimum gain is −1.27 dB for elevations above 10 degrees.

Figure 6:
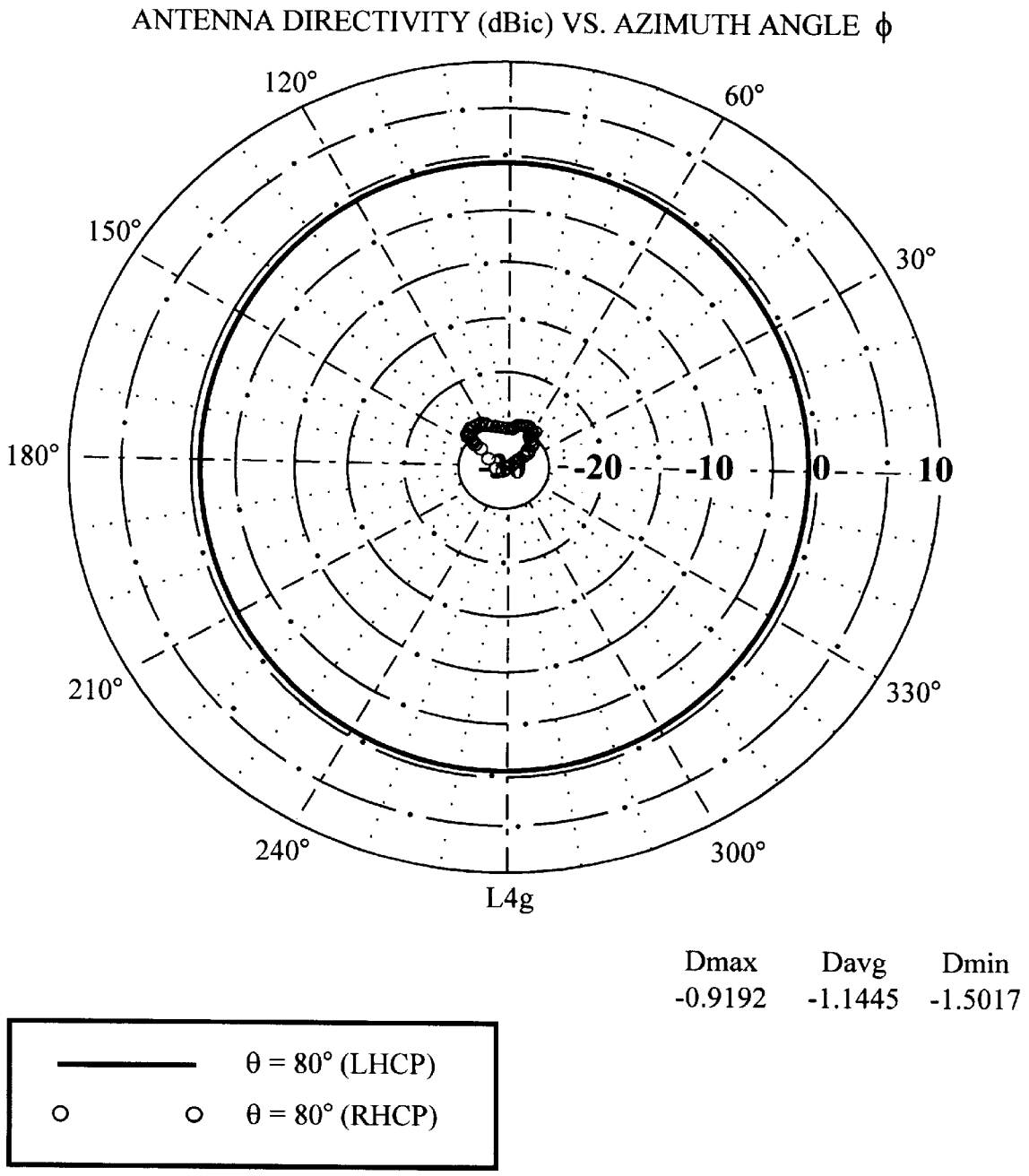
FIG. 6 illustrates a computer simulated antenna directivity vs. azimuth angle plot of the same antenna operating at 1.62 GHz.

FIG. 6 illustrates a computer simulated antenna directivity vs. azimuth angle plot of the same antenna at 10 degree elevation operating at 1.62 GHz. The simulation results indicate that the maximum gain is −0.92 dB, the average gain is −1.14 dB and the minimum gain is −1.50 dB at 10 degree elevation. Note that the cross-polarization (RHCP; or Right Hand Circular Polarization) is extremely low (less than −20 dB). This indicates that the dielectric resonator antenna has an excellent axial ratio even near the horizon.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What we claim as the invention is:

1. A dual band dielectric resonator antenna, comprising:

a first resonator formed of a dielectric material;

a first ground plane formed of a conductive material on which said first resonator is mounted;

a second resonator formed of a dielectric material;

a second ground plane formed of a conductive material on which said second resonator is mounted, said first and second ground planes being separated from each other by a predetermined distance; and first and second probes electrically coupled to each of said resonators spaced approximately 90 degrees apart around the perimeter of each resonator providing first and second signals, respectively, to each resonator, wherein each of said resonators resonates in a predetermined frequency band that differs between said resonators.

2. The antenna according to claim 1, wherein said first and said second signals have substantially equal amplitudes and 90 degrees phase difference with respect to each other.

3. The antenna according to claim 1, wherein each of said resonators is substantially cylindrical and has a central axial opening therethrough.

4. The antenna according to claim 1, wherein said first and second probes are spaced approximately 90 degrees apart around the perimeter of said resonator.

5. The antenna according to claim 1, wherein said first and second probes are substantially orthogonal with respect to said ground planes.

6. The antenna according to claim 1, wherein each of said resonators is formed of a ceramic material.

7. The antenna according to claim 6, wherein the dielectric constant $\epsilon_r$ of said ceramic material is greater than 10.

8. The antenna according to claim 6, wherein the dielectric constant $\epsilon_r$ of said ceramic material is greater than 45.

9. The antenna according to claim 6, wherein the dielectric constant of said ceramic material is greater than 100.

10. The dual band antenna according to claim 1, further comprising support members for mounting said first and second ground planes in spaced apart relation with a predetermined separation distance such that the central axes if said resonators are substantially aligned with each other.

11. A multiband antenna, comprising:

a first antenna portion tuned to resonate in a first predetermined frequency band, said first antenna portion including:

a ground plane formed of a conductive material, a dielectric resonator formed of a dielectric material mounted on said ground plane, said resonator having a central longitudinal axial opening therethrough, and first and second probes spaced apart from each other and electrically coupled to said resonator to provide first and second signals, respectively, to said resonator, and produce circularly polarized radiation in said antenna; and a second antenna portion tuned to resonate in a second predetermined frequency band different from said first frequency band, said second antenna portion including an elongated antenna member extending through said axial opening in said dielectric resonator and electrically isolated therefrom, the longitudinal axis of said elongated antenna member being coincident with the axis of said dielectric resonator.

12. A multiband antenna according to claim 11, wherein said elongated antenna member comprises a quadrifilar helix antenna.

13. A multiband antenna according to claim 11, further comprising a third antenna portion tuned to resonate in a third predetermined frequency band different from said first and second frequency bands, said third antenna portion extending through said axial opening in said dielectric resonator and being electrically isolated from said first and second antenna portions, and having a longitudinal axis coincident with the longitudinal axes of said first and second antenna portions.

14. A multiband antenna according to claim 13, wherein said second antenna portion comprises a quadrifilar helix antenna.

15. A multiband antenna according to claim 11, wherein said dielectric resonator has a substantially cylindrical shape.

* * * * *